US011555612B2

(12) United States Patent
Black et al.

(10) Patent No.: US 11,555,612 B2
(45) Date of Patent: Jan. 17, 2023

(54) DUAL FUEL DIRECT IGNITION BURNERS

(71) Applicant: Babcock Power Services, Inc., Marlborough, MA (US)

(72) Inventors: Stephen Black, Marlborough, MA (US); Patrick Roll, Natick, MA (US); Michael Grames, Spencer, MA (US); Max Goodwin, Fitchburg, MA (US); Justin Biccum, Springfield, MA (US); Raymond Legault, Oxford, MA (US); Bruce Soares, Cranston, RI (US); Darrell Dorman, West Boylston, MA (US)

(73) Assignee: Babcock Power Services, Inc., Marlborough, MA (US)

( * ) Notice: Subject to any disclaimer, the term of this patent is extended or adjusted under 35 U.S.C. 154(b) by 448 days.

(21) Appl. No.: 15/825,590

(22) Filed: Nov. 29, 2017

(65) Prior Publication Data

US 2019/0162410 A1 May 30, 2019

(51) Int. Cl.
*F23Q 9/10* (2006.01)
*F23D 14/48* (2006.01)
(Continued)

(52) U.S. Cl.
CPC ..... *F23Q 9/10* (2013.01); *F23C 7/00* (2013.01); *F23D 14/48* (2013.01); *F23D 17/002* (2013.01);
(Continued)

(58) Field of Classification Search
CPC ..... F23Q 9/10; F23Q 9/12; F23Q 2207/00; F23Q 13/02; F23D 14/48; F23D 17/002;
(Continued)

(56) References Cited

U.S. PATENT DOCUMENTS 2,863,498 A * 12/1958 Rogers ..... F23D 17/00 431/279
3,256,842 A * 6/1966 Vigneron ..... F23L 17/00 431/46
(Continued)

FOREIGN PATENT DOCUMENTS

EP 108923 A1 * 10/1983 ..... F23D 1/00
EP 0573300 B1 * 11/1996 ..... F23D 14/74
(Continued)

OTHER PUBLICATIONS

Forney Corporation, MaxFire Gas Ignitor Product Overview, published 2017 (4 pages).
(Continued)

*Primary Examiner* — Steven B McAllister
*Assistant Examiner* — Daniel E. Namay
(74) *Attorney, Agent, or Firm* — Locke Lord LLP; Joshua L. Jones; Gabrielle L. Gelozin

(57) ABSTRACT

A dual fuel burner system includes a fuel burner housing and a main fuel supply conduit within the fuel burner housing. A main fuel nozzle is positioned proximate to a downstream end of the fuel burner housing and is in fluid communication with the main fuel supply conduit. The main fuel supply conduit is configured to provide 100% of the heat input requirement of the dual fuel burner system. A secondary fuel supply conduit is within the fuel burner housing. The secondary fuel supply conduit is configured to provide 100% of the heat input requirement of the dual fuel burner system. An air circuit is in fluid communication with an outlet of the main fuel nozzle. A direct spark ignitor is positioned proximate to the outlet of the main fuel nozzle.

23 Claims, 11 Drawing Sheets

(51) Int. Cl.
*F23D 17/00* (2006.01)
*F23C 7/00* (2006.01)
*F23C 1/02* (2006.01)

(52) U.S. Cl.
CPC ..... *F23D 17/005* (2013.01); *F23D 17/007* (2013.01); *F23C 1/02* (2013.01); *F23D 2203/007* (2013.01); *F23D 2207/00* (2013.01); *F23D 2900/14003* (2013.01)

(58) Field of Classification Search
CPC ..... F23D 17/005; F23D 17/007; F23D 2203/007; F23D 2203/101; F23D 2900/14003; F23D 2204/10; F23D 2204/20; F23D 2204/30; F23C 1/02; F23C 1/04; F23C 1/06; F23C 1/10; F23C 1/12; F23C 2201/30; F23C 7/00
USPC ..... 431/279, 8
IPC ..... F23Q 9/10,13/02; F23D 14/48, 17/00; F23C 1/04, 1/12, 7/00
See application file for complete search history.

(56) References Cited

U.S. PATENT DOCUMENTS 3,894,834 A * 7/1975 Estes ..... F23N 1/02 431/174
4,241,673 A * 12/1980 Smith ..... F23D 1/00 110/264
4,412,808 A * 11/1983 Sheppard ..... F23D 11/12 239/397.5
4,431,403 A * 2/1984 Nowak ..... F23C 7/004 239/400
4,725,222 A * 2/1988 Koch ..... F23C 6/047 422/177
4,726,760 A * 2/1988 Skoog ..... F23C 7/00 110/265
4,836,772 A * 6/1989 LaRue ..... F23D 17/00 431/285
4,915,619 A * 4/1990 LaRue ..... F23D 17/00 431/284
5,203,692 A * 4/1993 Wexoe ..... F23C 7/06 110/262
5,240,410 A * 8/1993 Yang ..... F23D 17/002 239/400
5,513,583 A * 5/1996 Battista ..... F23D 1/005 110/104 B
5,697,306 A * 12/1997 LaRue ..... F23D 1/02 110/261
5,700,143 A * 12/1997 Irwin ..... F23D 17/002 431/182
5,826,423 A * 10/1998 Lockyer ..... F23C 7/008 60/39.463
6,142,765 A * 11/2000 Ramaseder ..... C21C 5/5217 239/406
6,183,240 B1 * 2/2001 Dobbeling ..... F23C 7/002 431/10
6,201,029 B1 * 3/2001 Waycuilis ..... C01B 3/382 252/373
6,238,206 B1 * 5/2001 Cummings, III ..... F23D 14/24 431/10
6,422,858 B1 * 7/2002 Chung ..... F23C 6/047 431/10
6,632,084 B2 * 10/2003 Berenbrink ..... F23D 17/002 431/284
7,909,601 B2 * 3/2011 Stephens ..... F23C 6/047 431/162
8,057,224 B2 * 11/2011 Knoepfel ..... F23D 17/002 431/354
8,075,305 B2 * 12/2011 Stephens ..... F23C 6/047 431/162
10,088,155 B2 * 10/2018 Baetz ..... F23D 14/22
10,443,855 B2 * 10/2019 Barve ..... F02C 3/30
2005/0028532 A1 * 2/2005 Bernero ..... F23C 7/002 60/776
2007/0172783 A1 * 7/2007 Stephens ..... F23C 6/047 431/278
2007/0172784 A1 * 7/2007 Stephens ..... F23D 17/00 431/278
2007/0172785 A1 * 7/2007 Stephens ..... F23C 6/047 431/278
2007/0259296 A1 * 11/2007 Knoepfel ..... F23D 17/002 431/9
2009/0061372 A1 * 3/2009 Just ..... F23D 1/00 431/284
2009/0123882 A1 * 5/2009 Eroglu ..... F23D 17/002 431/8
2010/0019063 A1 * 1/2010 Schroder ..... F23C 6/047 239/403
2013/0036740 A1 * 2/2013 Woerz ..... F23R 3/283 60/740
2013/0040255 A1 * 2/2013 Shi ..... C10J 3/503 431/354
2013/0255551 A1 * 10/2013 Xue ..... F23G 5/006 110/346
2015/0000285 A1 * 1/2015 Deiss ..... F02C 7/22 60/740
2015/0053124 A1 * 2/2015 Taniguchi ..... F23C 6/045 110/346
2015/0068438 A1 * 3/2015 Taniguchi ..... F23C 7/004 110/346
2015/0226421 A1 * 8/2015 Chothani ..... F01K 5/02 431/6
2016/0076762 A1 * 3/2016 Kraus ..... F23D 14/22 431/8
2016/0076763 A1 * 3/2016 Batz ..... F23C 6/047 431/187
2016/0178197 A1 * 6/2016 Rayssiguier ..... F23G 5/50 431/5
2017/0234542 A1 * 8/2017 Barve ..... F23R 3/36 60/746
2018/0202649 A1 * 7/2018 Ristic ..... F23B 90/02
2019/0249922 A1 * 8/2019 Miwa ..... F27B 3/085

FOREIGN PATENT DOCUMENTS

JP 2010071576 A * 4/2010
JP 2011012836 A * 1/2011
JP 2011112345 A * 6/2011
JP 2013194994 A * 9/2013 ..... F23D 1/00
JP 2014173777 A * 9/2014

OTHER PUBLICATIONS

Forney Corporation, MaxFire Gas Ignitor Product Overview, published 2014 (2 pages).
India Examination Report dated Mar. 31, 2022, issued during the prosecution of India Patent Application No. 201814044872. (6 pages).
Israel Office Action dated Jan. 25, 2022, issued during the prosecution of Israel Patent Application No. 266905 (4 pages).

* cited by examiner

DUAL FUEL DIRECT IGNITION BURNERS

BACKGROUND OF THE INVENTION

1. Field of the Invention

The present invention relates to fuel burners, and more particularly to dual fuel burners.

2. Description of Related Art

A traditional industry dual fuel burner design has two main fuel supplies, two burner elements, as well as one fuel ignitor that has an ignition fuel supply and one ignition burner element. The main burner fuels can be coal, oil, or gas, and the ignition fuels are typically either oil or gas. The amount of equipment to be designed, supplied and maintained can be quite substantial, with a total of three fuel supply systems and three burner elements, each of which requires auxiliary systems such as flame scanners, controls, and air supplies.

The fuel ignitor typically fires a small amount of oil or natural gas as ignition fuel for either of the two main burners. The design heat input capacity of the fuel ignitor is typically no more than 10% of the main burner heat input at full load. In some cases, high capacity igniters can satisfy up to 35% of the burner heat input. Traditional fuel ignitors can include a sparker for light off, often with a continuous electrode which is air insulated from a stainless steel carrier tube. The fuel ignitor has a flame detection device, typically an optical flame scanner or flame rod. A valve train is required to supply the ignitor fuel gas or oil and atomizing media (if required) to the ignitors. The valve trains are designed to meet various codes, standards, and guidelines such as NFPA and ASME, which include the use of pressure regulating valves, manual isolation valves, atomizing valves, check valves, strainers, and instrumentation such as pressure switches, pressure gauges, local control junction boxes, and LED indicators. Fuel ignitors may also require dedicated combustion/cooling air on some applications, which creates a need for a blower skid assembly to provide this air. These blower skids typically include blowers with fan motors, space heaters, vibration isolators, actuated isolation valves, check valves, filter-silencers, and instrumentation such as starter assemblies, junction boxes, solenoids, and limit switches.

Such conventional methods and systems have generally been considered satisfactory for their intended purpose. However, there is still a need in the art for improved dual fuel burners that allow for improved ease of use, manufacture, assembly and installation, as well as the ability to fire 100% of either fuel, to allow taking advantage of fuel pricing fluctuations/disparity. The present invention provides a solution for these problems.

SUMMARY OF THE INVENTION

A dual fuel burner system includes a fuel burner housing and a main fuel supply conduit within the fuel burner housing. A main fuel nozzle is positioned proximate to a downstream end of the fuel burner housing and is in fluid communication with the main fuel supply conduit. The main fuel supply conduit is configured to provide 100% of the heat input requirement of the dual fuel burner system. A secondary fuel supply conduit is within the fuel burner housing. The secondary fuel supply conduit is configured to provide 100% of the heat input requirement of the dual fuel burner system. An air circuit is in fluid communication with an outlet of the main fuel nozzle. A direct spark ignitor is positioned proximate to the outlet of the main fuel nozzle.

The main fuel supply conduit can be a gas fuel supply conduit and/or an oil fuel supply conduit. A secondary fuel nozzle can be positioned proximate to the downstream end of the fuel burner housing in fluid communication with the secondary fuel supply conduit. The secondary fuel supply conduit can be a coal fuel supply conduit. The secondary fuel supply conduit can be in fluid communication with a secondary fuel supply different from a main fuel supply in fluid communication with the main fuel supply conduit.

The system can include a flame scanner proximate to the outlet of the main fuel nozzle. The outlet of the main fuel nozzle can include a diffusing element to create a low pressure recirculation-ignition zone in an airflow path downstream from the air circuit. The diffusing element can include a perforated plate, a diverging conical body, and/or a set of trapezoidal shaped plates.

In accordance with some embodiments, a guide tube is mounted to a downstream end of the main fuel nozzle. The direct spark ignitor can be nested within the guide tube for support. It is contemplated that the system can include a retraction mechanism operatively connected to an upstream end of the direct spark ignitor. The direct spark ignitor can be retractable relative to the fuel burner housing to be extended for light-off and retracted in an upstream direction when not in use. The system can include a retraction mechanism operatively connected to the main fuel nozzle. The main fuel nozzle can be retractable relative to the fuel burner housing to be retracted in an upstream direction when not in use.

In accordance with another aspect, a method of operating a dual fuel burner system includes extending a direct spark ignitor within a dual fuel burner housing proximate to an outlet of a main fuel nozzle. The method includes igniting a main fuel flow from a main fuel supply conduit exiting from the outlet of the main fuel nozzle with the direct spark ignitor to place the fuel burner system into service. The method includes retracting the direct spark ignitor.

In some embodiments, the main fuel nozzle is one of a plurality of main fuel nozzles each having respective outlets. The method can include supplying the main fuel flow through the main fuel supply conduit to the outlets of the main fuel nozzles. The method can include increasing the main fuel flow to the main fuel nozzle by a factor of ten. In embodiments where it is desired to switch to a secondary fuel source, the method includes reducing the main fuel flow to the main fuel nozzle by ninety percent. The method can include supplying a secondary fuel flow through a secondary fuel supply conduit to an outlet of a secondary fuel nozzle proximate the main fuel nozzle to ignite the secondary fuel flow. The method can include stopping the main fuel flow to the main fuel nozzle. The secondary fuel nozzle can be one of a plurality of secondary fuel nozzles each having respective outlets. Supplying the secondary fuel flow through the secondary fuel supply conduit to the outlet of the secondary fuel nozzle can include supplying the secondary fuel flow through the secondary fuel supply conduit to the outlets of the plurality of secondary fuel nozzles.

In some embodiments, the method includes supplying a secondary fuel flow through a secondary fuel supply conduit to an outlet of a secondary fuel nozzle proximate the main fuel nozzle to ignite the secondary fuel flow. The method can include stopping the main fuel flow through the main fuel nozzle. The method can include reducing the secondary fuel flow to the secondary fuel nozzle. The method can include supplying the main fuel flow through the main fuel supply conduit to the outlet of the main fuel nozzle proximate the secondary fuel nozzle to ignite the main fuel flow. The method can include stopping the secondary fuel flow to the secondary fuel nozzle.

These and other features of the systems and methods of the subject invention will become more readily apparent to those skilled in the art from the following detailed description of the preferred embodiments taken in conjunction with the drawings.

BRIEF DESCRIPTION OF THE DRAWINGS

So that those skilled in the art to which the subject invention appertains will readily understand how to make and use the devices and methods of the subject invention without undue experimentation, preferred embodiments thereof will be described in detail herein below with reference to certain figures, wherein.

DETAILED DESCRIPTION OF THE PREFERRED EMBODIMENTS

Figure 1:
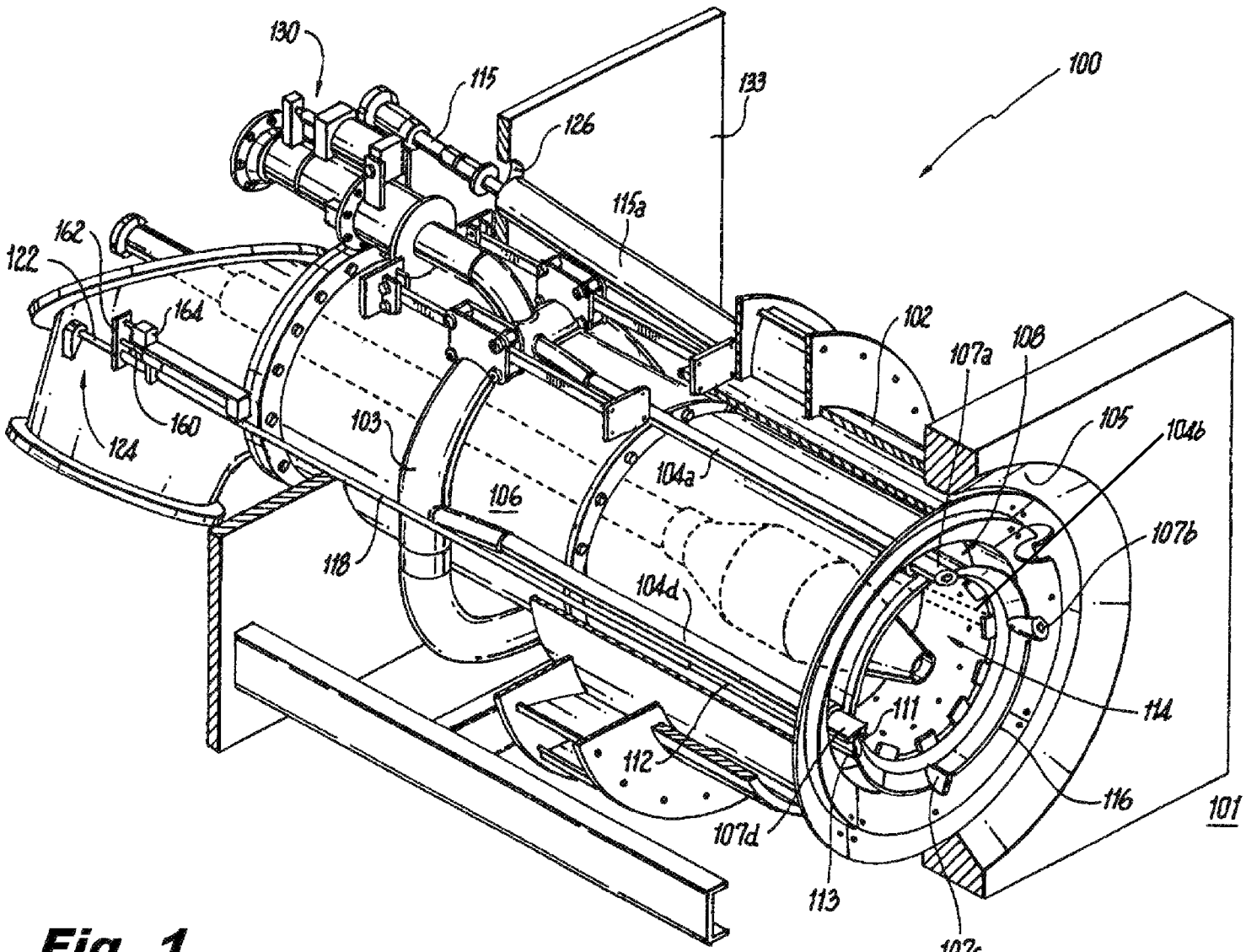
FIG. 1 is a perspective view of an exemplary embodiment of a wall-fired dual fuel direct ignition burner system constructed in accordance with embodiments of the present invention, showing the tip of the direct spark ignitor positioned proximate to the outlet of one of the main fuel nozzles.

Reference will now be made to the drawings wherein like reference numerals identify similar structural features or aspects of the subject invention. For purposes of explanation and illustration, and not limitation, a partial view of an exemplary embodiment of a dual fuel burner system in accordance with the invention is shown in FIG. 1 and is designated generally by reference character 100. Other embodiments of dual fuel burner systems in accordance with the invention, or aspects thereof, are provided in FIGS. 2A-8, as will be described.

Dual fuel burners with direct ignition, as described below, provide advantages over conventional dual fuel burners. The dual fuel burner systems 100, 200 and 300, use two fuel supplies and burner elements but do not require a separate ignition fuel supply and burner element. Instead of separate ignition fuel supply and burner element associated therewith, dual fuel burner systems, as described below, include a direct spark ignitor that operates to ignite one or more of the two fuel supplies. The direct spark ignitor directly ignites the fuel from a main gas burner by a high-energy spark. This precludes the need for a traditional gas or oil ignitor system with a pilot flame. The use of the direct ignition simplifies the burner design and operation by eliminating the complexity associated with traditional fuel ignitors, and their associated fuel supplies, burner elements, and auxiliary equipment. Each fuel supply is configured to be capable of providing 100% of the heat input requirement of the dual fuel burner system. The direct ignition and dual fuel burner design has superior technology features not available in traditional dual fuel burner and ignition systems. A dual fuel burner system can be utilized on a variety of boiler and firing system types including wall fired, tangentially fired, and turbo fired.

Figure 2A:
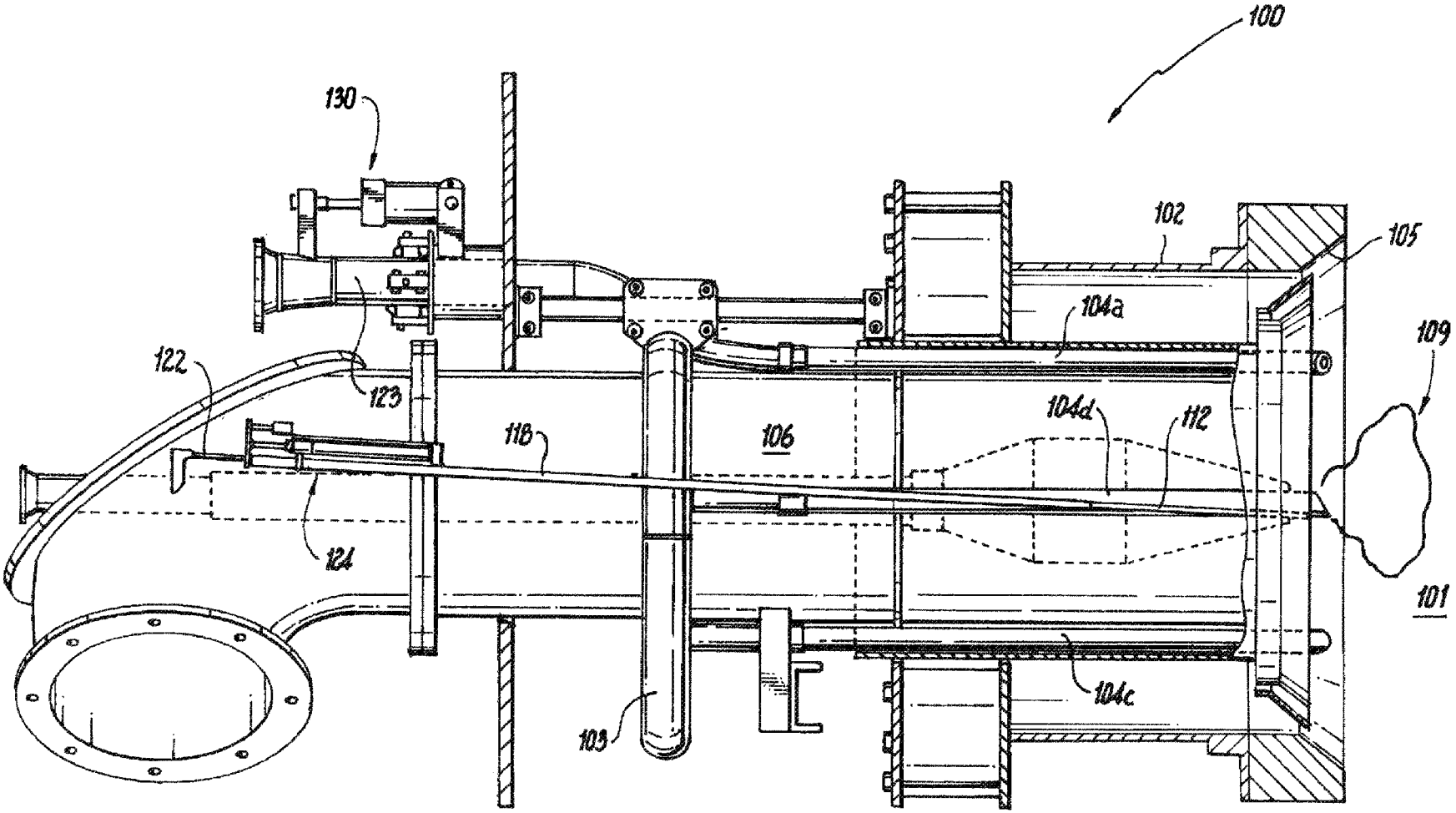
FIG. 2A is a side view of the wall-fired dual fuel direct ignition burner system of FIG. 1, showing the tip of the direct spark ignitor positioned proximate to the outlet of one of the main fuel nozzles in an un-retracted, deployed position.
Figure 2B:
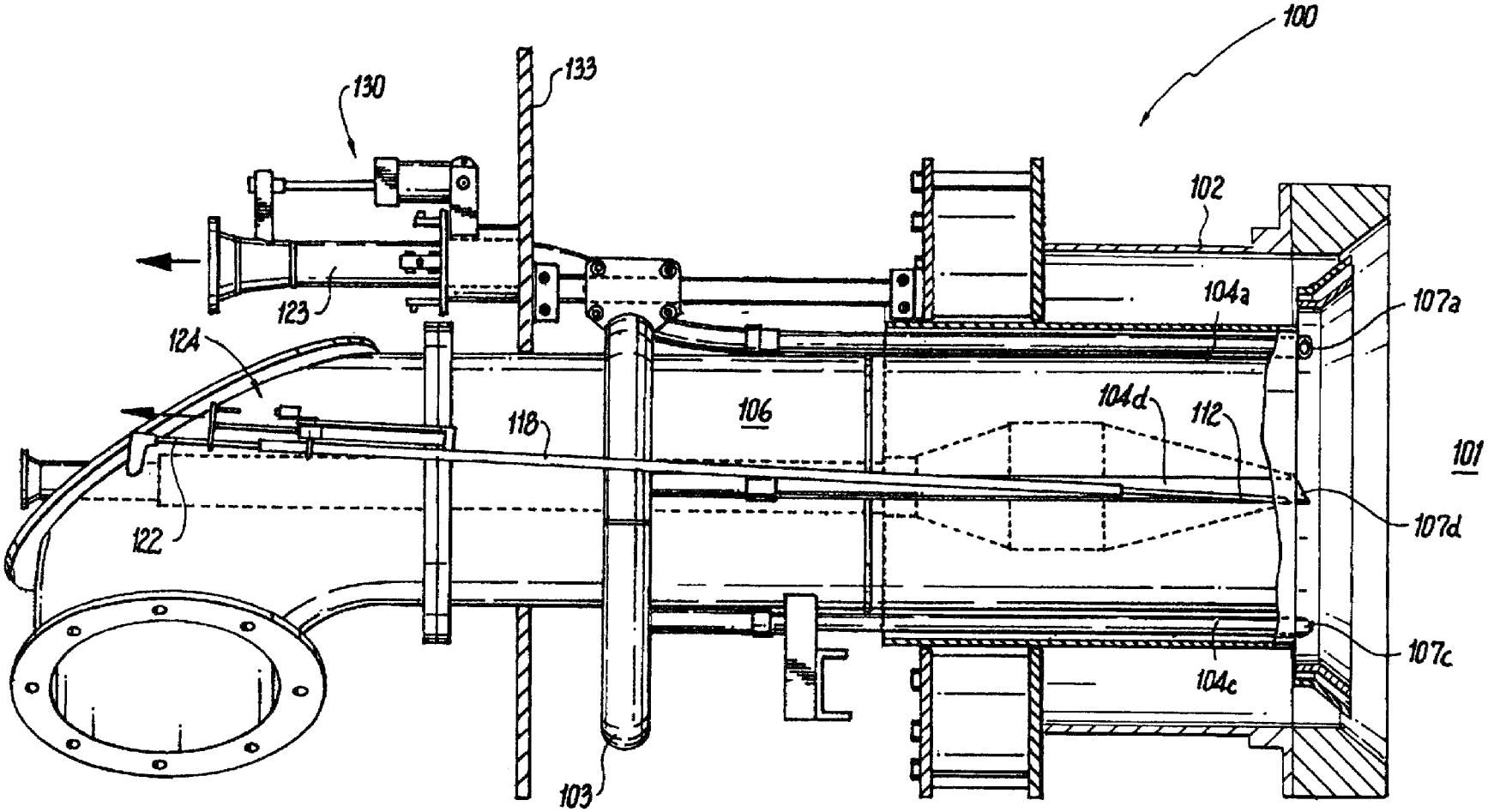
FIG. 2B is a side view of the wall-fired dual fuel direct ignition burner system of FIG. 1, showing the tip of the direct spark ignitor positioned proximate to the outlet of one of the main fuel nozzles in a retracted, un-deployed position.

With reference to FIGS. 1-2B, an embodiment of a wall-fired dual fuel direct ignition burner system, e.g. dual fuel burner system 100, is shown. Wall-fired dual fuel direct ignition burner system 100 includes a fuel burner housing 102 and a series of main fuel supply conduits 104*a*-104*d*, within the fuel burner housing 102. Main fuel supply conduit 104*b* is not visible in the figures for sake of clarity, but extends from a fuel distributor 103 in a direction similar to main fuel supply conduit 104*d*, except that main fuel supply conduit 104*b* is positioned approximately 180 degrees away from main fuel supply conduit 104*d*. A plurality of main fuel nozzles 107*a*-107*d* are positioned proximate to a downstream end 105 of fuel burner housing 102. Each main fuel nozzle 107*a*-107*d* is in fluid communication with a respective one of main fuel supply conduits 104*a*-104*d*. Main fuel supply conduits 104*a*-104*d* are gas fuel supply conduits for connecting to a supply of gas fuel. However, it is contemplated that main fuel supply conduits 104*a*-104*d* can be oil fuel supply conduits connected to an oil fuel supply.

As shown in FIG. 1, a secondary fuel supply conduit 106 is within fuel burner housing 102. A secondary fuel nozzle 114 is positioned proximate to the downstream end 105 of fuel burner housing 102 in fluid communication with secondary fuel supply conduit 106. Secondary fuel supply conduit 106 is a coal fuel supply conduit. However, it is contemplated that secondary fuel supply conduit 106 can be an oil fuel supply conduit or gas fuel supply conduit.

Secondary fuel supply conduit 106 is in fluid communication with a secondary fuel supply different from the main fuel supply in fluid communication with main fuel supply conduits 104*a*-104*d*. An air circuit 108 is in fluid communication with outlets of main fuel nozzles 107*a*-107*d*. A tip 113 of direct spark ignitor 112 is positioned proximate to an outlet 111 of main fuel nozzle 107*d*.

As shown in FIGS. 1 and 2A, system 100 includes a flame scanner 115 with a sight tube 115*a* mounted to an upstream wall 133 of burner housing 102. Sight tube 115*a* is aimed so that it views adjacent to the fuel nozzles 107*a*-107*d* and can sight the flame. System 100 includes a diffusing element 116 proximate to outlets of main fuel nozzles 107*a*-107*d* to create a low pressure recirculation-ignition zone 109 in an airflow path downstream from air circuit 108. In system 100, diffusing element 116 is a diverging conical body. Diffusing element 116, e.g. a bluff body device, creates low-pressure recirculation/ignition zone 109 in the airflow path of burner system 100 immediately as it exits burner system 100 and enters a furnace 101. Diffusing element 116 is positioned proximate to the outlets of main gas fuel nozzles 107*a*-107*d* such that the recirculation zone 109 will occur at the ignition location of the direct ignition main gas fuel nozzles 107*a*-107*d*. Diffusing element 116 creates a zone for the mixing of fuel and air that remains stable under varying burner settings and fuel and airflows, thereby reducing $NO_x$ emissions as compared with traditional burner systems. Diffusing element 116 also allows consistent and reliable light-off of the main gas burner nozzles using direct ignition under varying conditions. For sake of clarity and to show the position of fuel nozzles 107*a*-107*d*, diffusing element 116 is not shown in FIGS. 2A and 2B.

With continued reference to FIGS. 1-2B, a guide tube 118 is mounted to burner housing 102. Direct spark ignitor 112 is nested within guide tube 118 for support. System 100 includes a retraction mechanism 124 operatively connected to an upstream end 122 of direct spark ignitor 112 and guide tube 118. Retraction mechanism 124 includes an actuator 160 to drive a plate 162 mounted to direct spark ignitor 112 in an upstream direction and a limit switch 164 configured to stop actuator 160 when needed. Direct spark ignitor 112 is retractable relative to fuel burner housing 102 to be extended downstream for light off and retracted in an upstream direction when not in use. FIG. 2A shows direct spark ignitor 112 in a deployed, un-retracted position.

Figure 6:
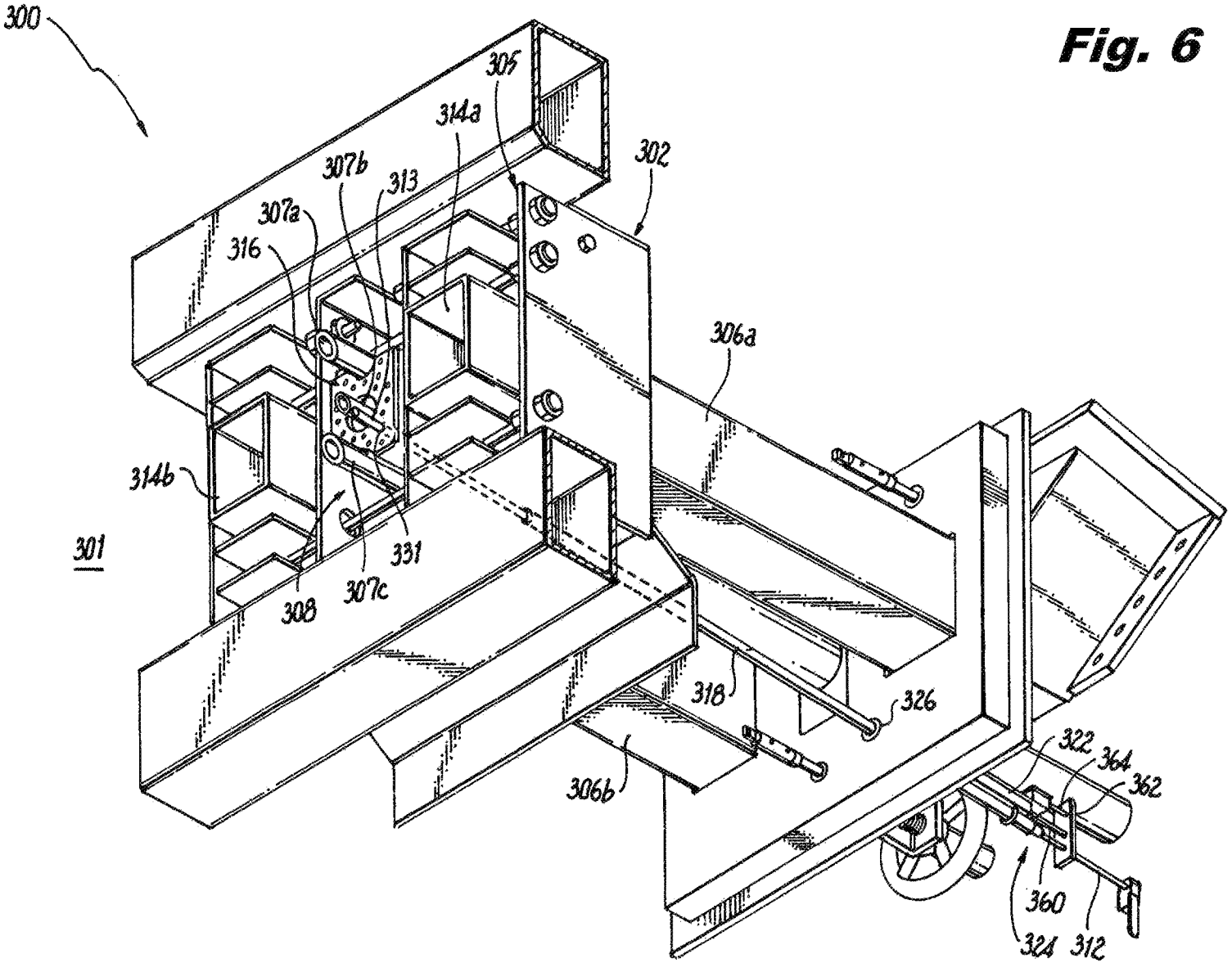
FIG. 6 is a perspective underside view of an exemplary embodiment of a turbo fired dual fuel direct ignition burner system constructed in accordance with embodiments of the present invention, showing the tip of the direct spark ignitor positioned proximate to the outlet of one of the main fuel nozzles.

FIG. 2B shows direct spark ignitor 112 in an un-deployed, retracted position, as indicated schematically by the arrow pointing in the upstream direction. This retraction mechanism 124 allows for easier maintainability and longer life of direct spark igniter. Moreover, due to the retraction capability, direct spark ignitor 112 does not require the dedicated air supplies for cooling, etc. found in traditional burner systems, because direct spark ignitor 112 can be retracted when not in service to cool. Access holes, similar to those shown in FIG. 6, are contained within upstream wall 133 of burner housing 102 to accommodate the retraction and extension of direct spark igniter 112.

With continued reference to FIGS. 1 and 2A, system 100 includes a nozzle retraction mechanism 130 operatively connected to an upstream end 123 of fuel distributor 103, main fuel supply conduits 104*a*-104*d*, and main fuel nozzles 107*a*-107*d*. Main fuel supply conduits 104*a*-104*d*, main fuel nozzles 107*a*-107*d* and fuel distributor 103 are retractable relative to fuel burner housing 102 to be extended when the fuel supply through fuel distributor 103 is in use and retracted upstream when not in use. FIG. 2A shows main fuel nozzles 107*a*-107*d*, main fuel supply conduits 104*a*-104*c*, and fuel distributor 103 in a deployed, un-retracted position. FIG. 2B shows main fuel nozzles 107*a*-107*d*, main fuel supply conduits 104*a*-104*d*, and fuel distributor 103 in an un-deployed, retracted position, as indicated schematically by the arrow pointing in the upstream direction. This nozzle retraction mechanism 130 allows for easier maintainability and longer life of the nozzles and conduits. When firing, for example, coal but not gas, the retraction of one or more main fuel nozzles 107*a*-107*d* prevents the gas elements from collecting coal slag and ash that can affect burner performance, and also protects against erosion. The retraction further prevents main fuel nozzles 107*a*-107*d*, e.g. gas elements, from overheating when firing coal in the same burner or when the burner is out of service but other burners are in service. It is contemplated that in some embodiments, secondary fuel nozzles can be considered the main fuel nozzles and vice a versa. Access holes 126 are included within upstream wall 133 of burner housing 102 to accommodate the retraction and extension of fuel distributor 103.

Figure 3:
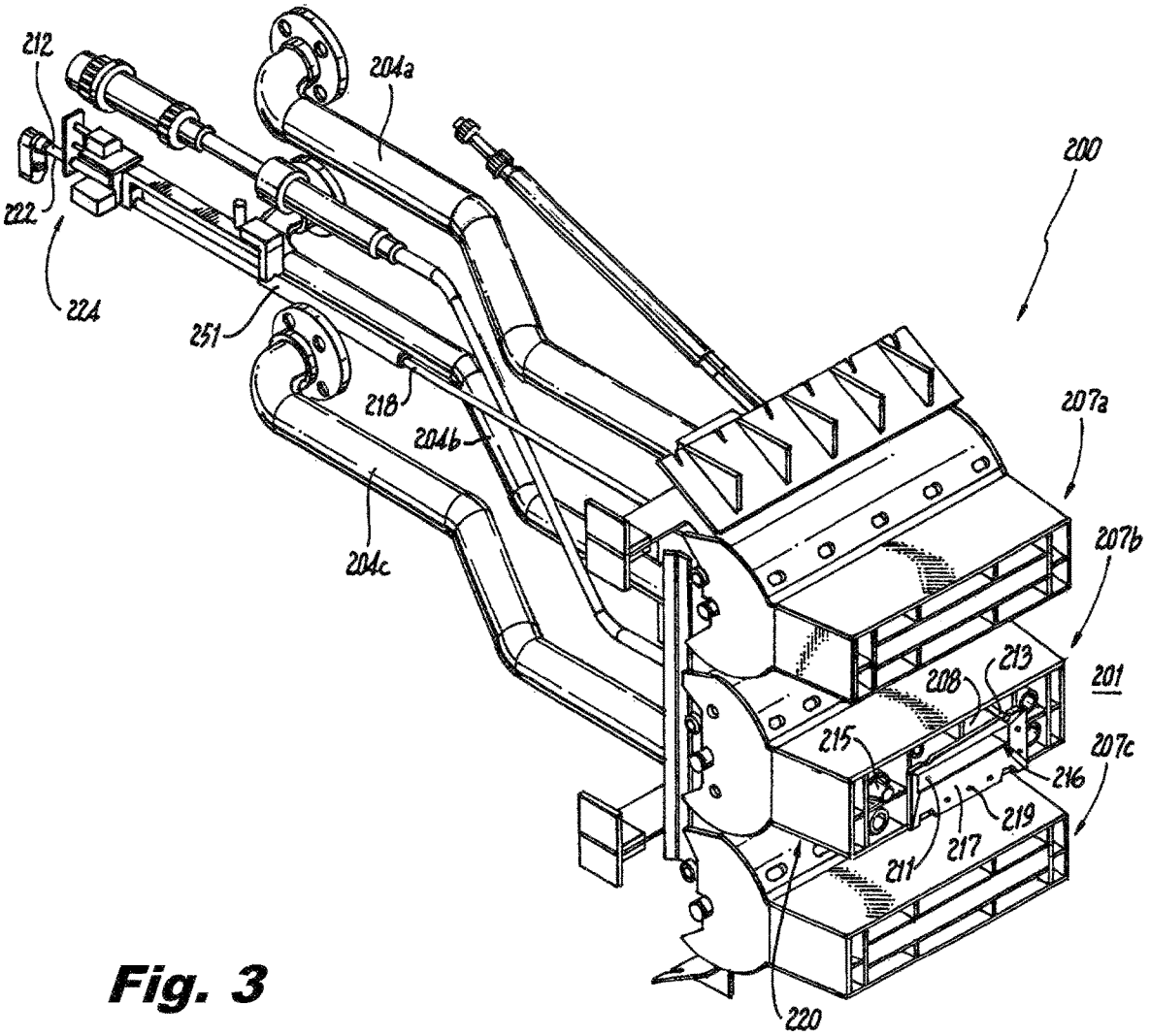
FIG. 3 is a perspective view of an exemplary embodiment of a tangentially fired dual fuel direct ignition burner system constructed in accordance with embodiments of the present invention, showing the tip of the direct spark ignitor positioned proximate to the outlet of one of the main fuel nozzles.
Figure 4:
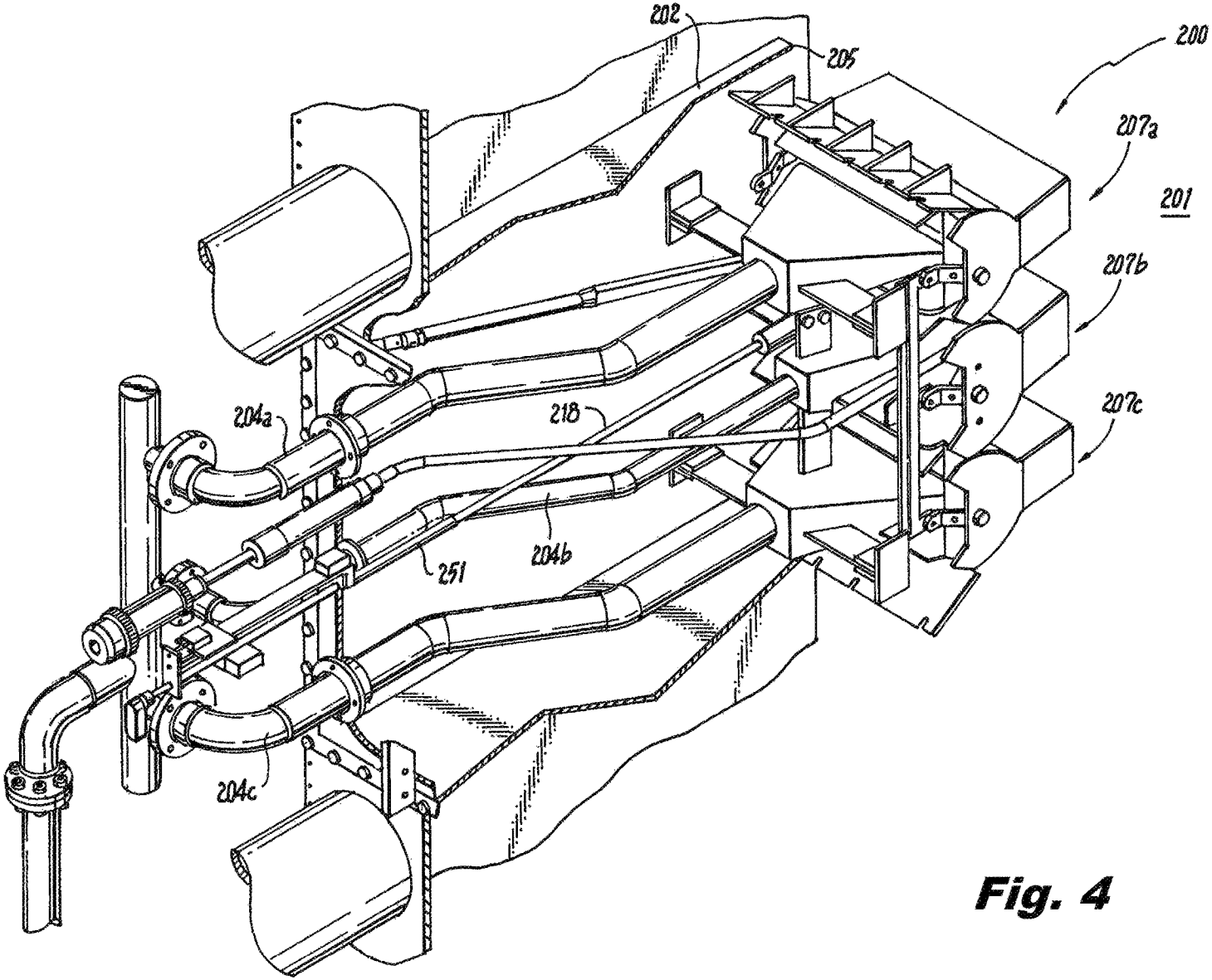
FIG. 4 is a perspective view of the tangentially fired dual fuel direct ignition burner system of FIG. 3 from an upstream side, showing the direct spark ignitor retraction mechanism.

With reference now to FIGS. 3-4, a tangentially fired dual fuel direct ignition burner system, e.g. dual fuel burner system 200, includes a fuel burner housing 202 and a series of main fuel supply conduits 204*a*-204*c*, within fuel burner housing 202. Main fuel nozzles 207*a*-207*c* are positioned proximate to a downstream end 205 of fuel burner housing 202. Each main fuel nozzle 207*a*-207*c* is in fluid communication with a respective one of main fuel supply conduits 204*a*-204*c*. Main fuel supply conduits 204*a*-204*c* are gas fuel supply conduits. However, it is contemplated that main fuel supply conduits 204*a*-204*c* can be oil fuel supply conduits.

Figure 5A:
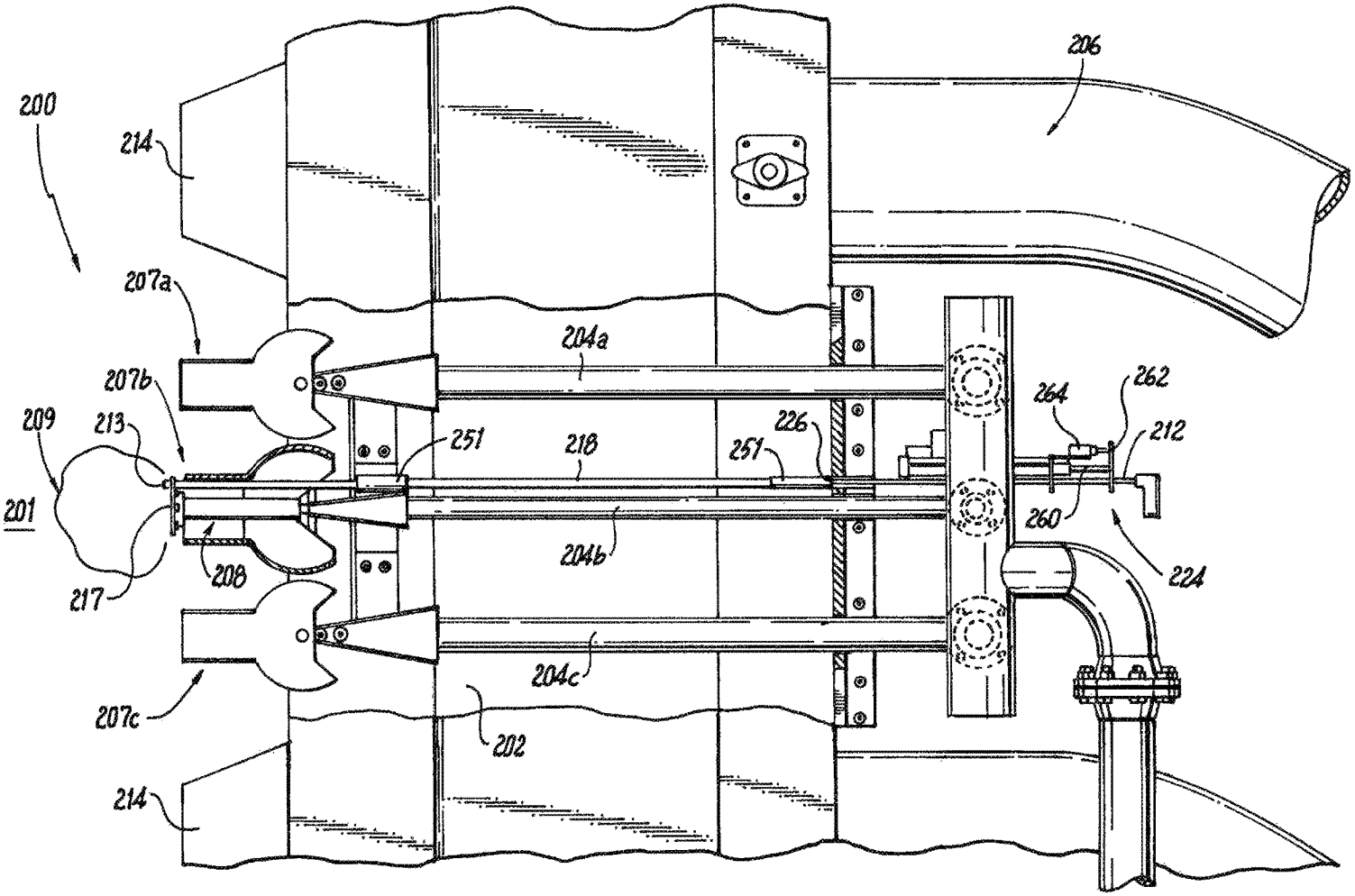
FIG. 5A is a side view of the tangentially fired dual fuel direct ignition burner system of FIG. 3, showing the tip of the direct spark ignitor positioned proximate to the outlet of one of the main fuel nozzles in an un-retracted, deployed position.
Figure 5B:
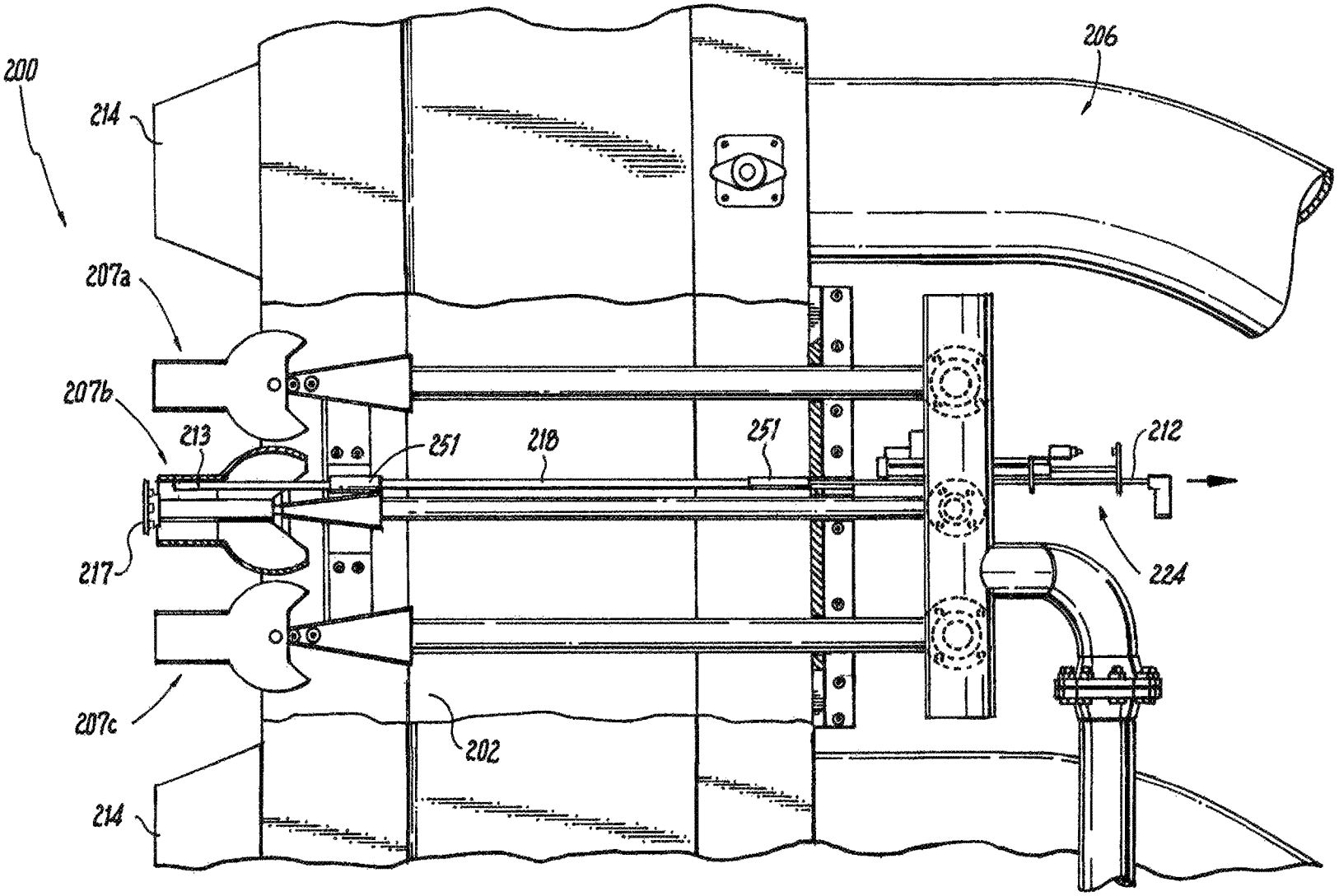
FIG. 5B is a side view of the tangentially fired dual fuel direct ignition burner system of FIG. 3, showing the tip of the direct spark ignitor positioned proximate to the outlet one of the main fuel nozzles in a retracted, un-deployed position.

As shown in FIGS. 5A and 5B, a secondary fuel supply conduit 206 is within fuel burner housing 202. A secondary fuel nozzle 214 is positioned proximate to downstream end 205 of fuel burner housing 202 in fluid communication with secondary fuel supply conduit 206. In tangential-fired dual fuel direct ignition burner system 200, secondary fuel supply conduit 206 is a coal fuel supply conduit. However, it is contemplated that secondary fuel supply conduit 206 can be an oil fuel supply conduit. An air circuit 208 is in fluid communication with a fuel path outlet 211 of one of main fuel nozzles 207*b*. A tip 213 of direct spark ignitor 212 is positioned proximate to fuel path outlet 211 of main fuel nozzle 207*b*.

With reference now to FIG. 3, system 200 includes a flame scanner 215 proximate to the outlet of main fuel nozzle 207*a*. The outlet of main fuel nozzle 207*a* includes a diffusing element 216 downstream from air circuit 208 to create a low pressure recirculation-ignition zone 209 in an airflow path downstream from air circuit 208 and the outlet of main gas fuel nozzle 207*b*. In system 200, diffusing element 216 is a set of four trapezoidal shaped plates 217 arranged to form a diverging flow path downstream from the fuel path outlet. It is also contemplated that diffusing element can be formed unitarily. Each lateral edge of each trapezoidal shaped plate 217 abuts a corresponding respective lateral edge of an adjacent plate 217 to form a truncated pyramid shape. Diffusing element 216 also includes perforations 219. Diffusing element 216, e.g. a bluff body device, creates low pressure recirculation/ignition zone 209 by disturbing the airflow from air circuit 208 of the burner immediately as it exits burner system 200 and enters a furnace 201. Diffusing element 216 is positioned at the outlet of main gas fuel nozzle 207*b* such that the recirculation zone 209 will occur at the ignition location of main gas fuel nozzle 207*b*. This diffusing element 216 creates a zone 209 for the mixing of fuel and air that remains stable under varying burner settings and fuel and air flows, thereby reducing $NO_x$ emissions as compared with traditional burner systems. Diffusing element 216 also allows consistent and reliable light-off of main gas fuel nozzle 207*b* using direct ignition under varying conditions.

As shown in FIGS. 3-5B, a guide tube 218 is mounted to a downstream end 220 of one of main fuel nozzles 207*a*. Direct spark ignitor 212 is nested within guide tube 218 for support. Guide tube 218 can also be supported by sleeves 251. System 200 includes a retraction mechanism 224 operatively connected to an upstream end 222 of direct spark ignitor 212. Retraction mechanism 224 includes an actuator 260 to drive a plate 262 mounted to direct spark ignitor 212 in an upstream direction and a limit switch 264 configured to stop actuator 260 when needed. Direct spark ignitor 212 is retractable relative to fuel burner housing 202 to be extended for light-off and retracted in an upstream direction when not in use. FIG. 5A shows direct spark ignitor 212 in a deployed, un-retracted position. FIG. 5B shows direct spark ignitor 212 in an un-deployed, retracted position, as indicated schematically by the arrow pointing in the upstream direction. This retraction mechanism allows for easier maintainability and longer life of direct spark igniter 212. It is contemplated that an access hole 226, similar to access hole 126, is included within burner housing 202 to accommodate the retraction and extension of the direct spark igniter.

Figure 7A:
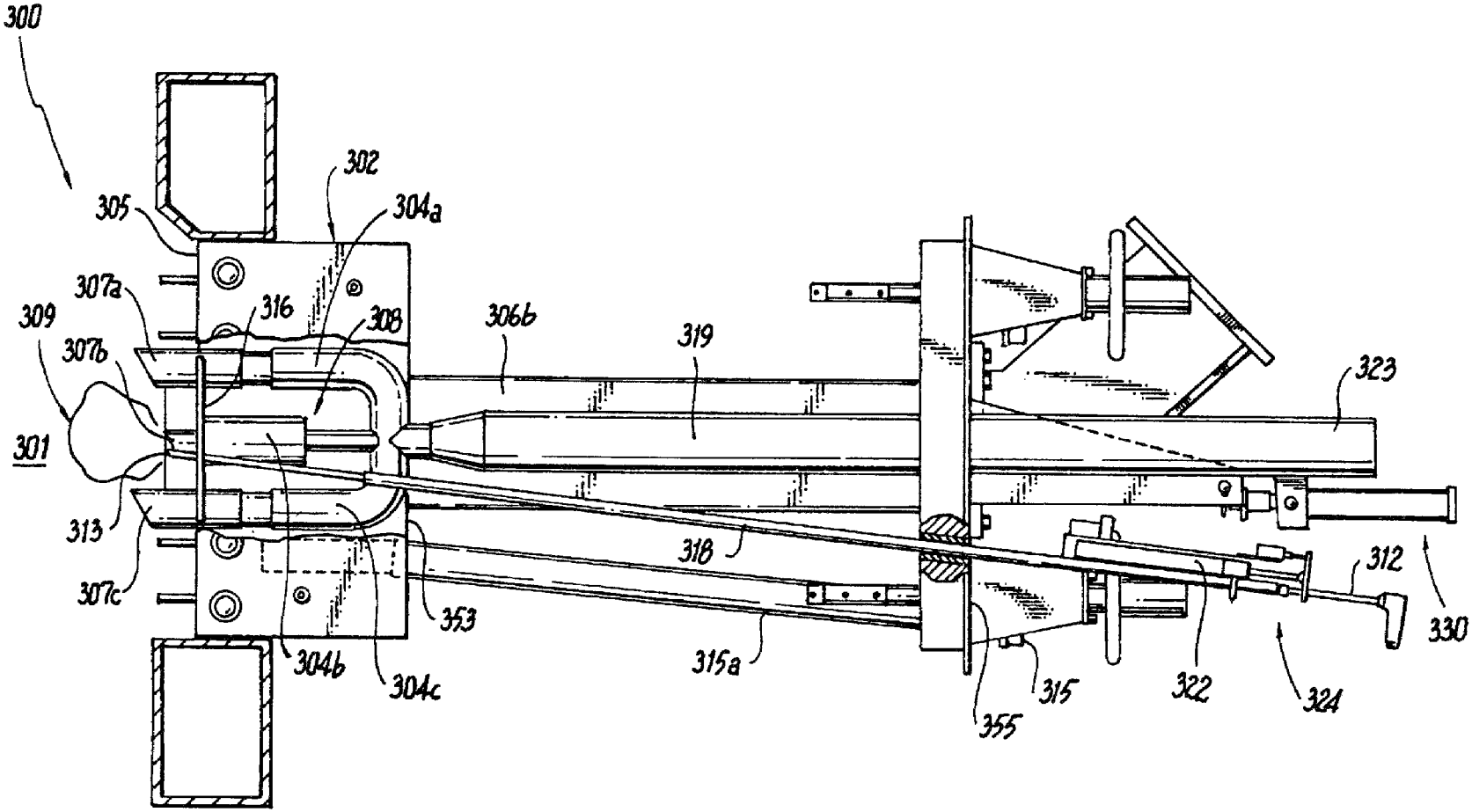
FIG. 7A is a side view of the system of FIG. 6, showing the tip of the direct spark ignitor positioned proximate to the outlet of one of the main fuel nozzles in a un-retracted, deployed position.
Figure 7B:
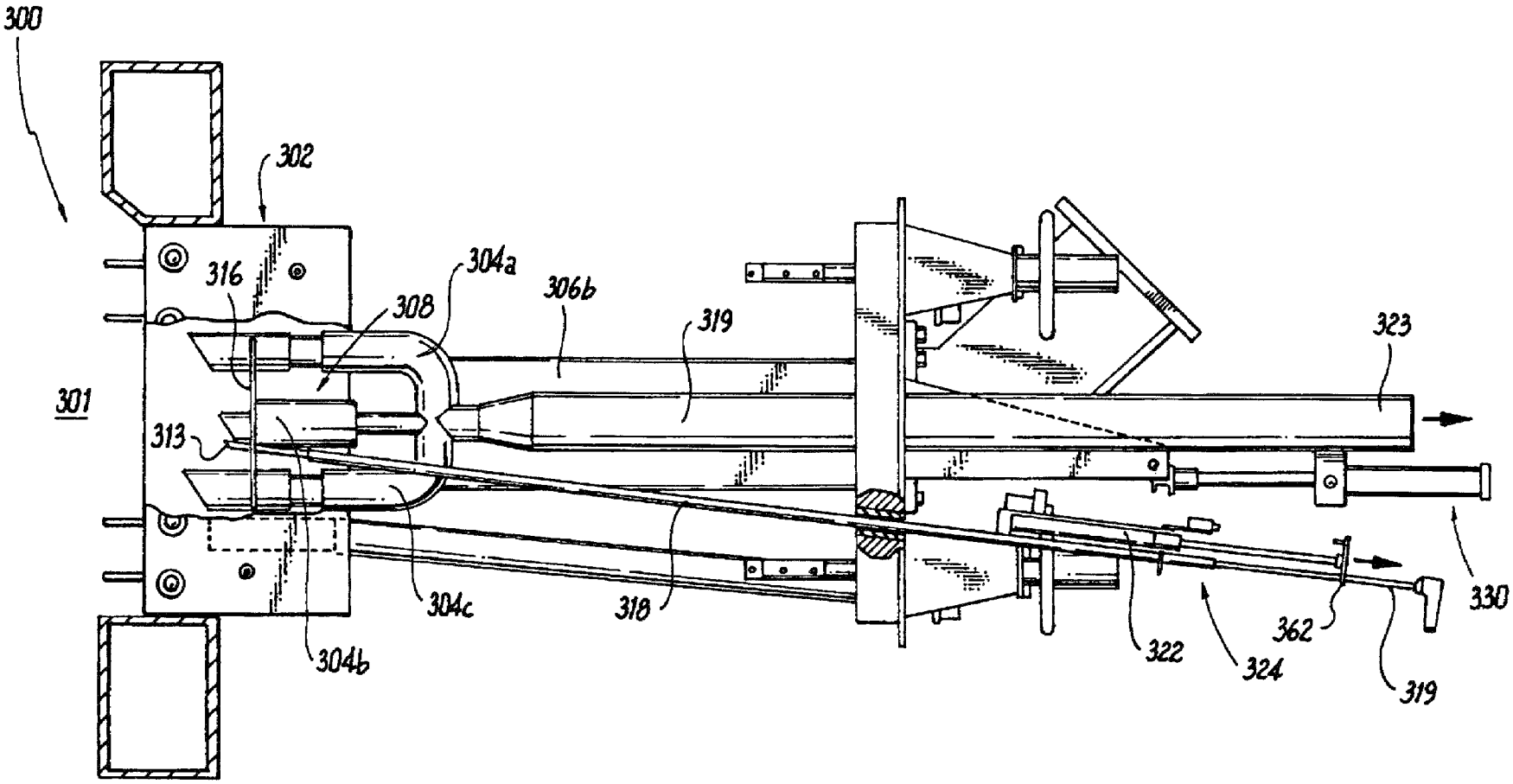
FIG. 7B is a side view of the system of FIG. 6, showing the tip of the direct spark ignitor and the main fuel nozzles in a retracted, un-deployed position.
Figure 8:
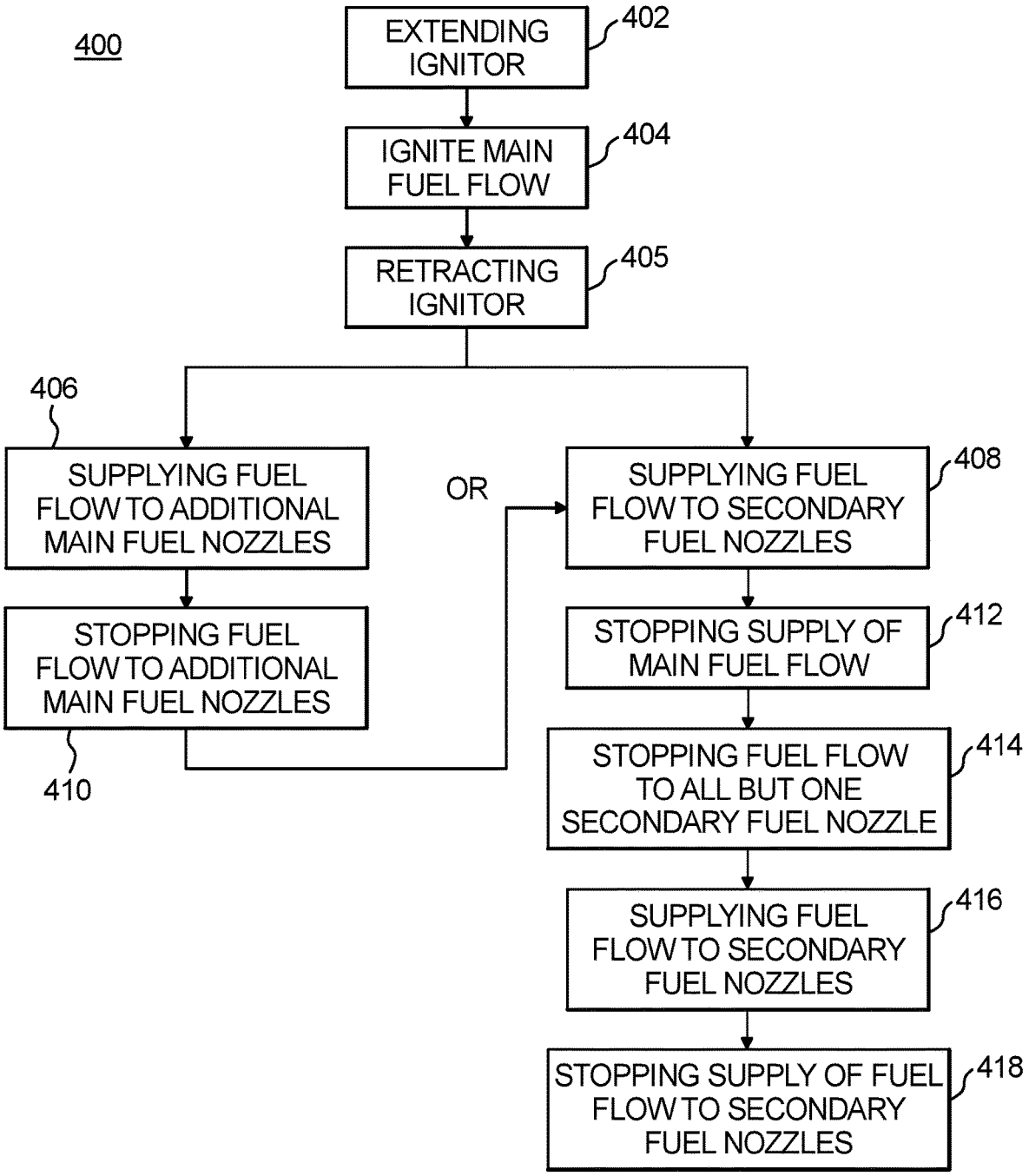
FIG. 8 is a schematic diagram showing an exemplary embodiment of a method of operating a dual fuel burner system.

With reference now to FIGS. 6 and 7A and 7B, a turbo fired dual fuel direct ignition burner system 300, e.g. dual fuel burner system 300, includes a fuel burner housing 302 and main fuel supply conduits 304*a*-304*c* within fuel burner housing 302. Main fuel nozzles 307*a*-307*c* are positioned proximate to a downstream end 305 of fuel burner housing 302. Each main fuel nozzle 307*a*-307*c* is in fluid communication with a respective main fuel supply conduit 304*a*-304*c*. Main fuel supply conduits 304*a*-304*c* are gas fuel supply conduits. However, it is contemplated that main fuel supply conduits 304*a*-304*c* can be oil fuel supply conduits. Secondary fuel supply conduits 306*a* and 306*b* are within fuel burner housing 302. Secondary fuel supply conduits 306*a* and 306*b* are coal fuel supply conduits. However, it is contemplated that secondary fuel supply conduits 306*a* and 306*b* can be oil fuel supply conduits.

As shown in FIGS. 6-7A, secondary fuel nozzles 314*a* and 314*b* are positioned proximate to downstream end 305 of fuel burner housing 302. Each of secondary fuel nozzles 314*a* and 314*b* are in fluid communication with a respective one of secondary fuel supply conduits 306*a* and 306*b*. An air circuit 308 is in fluid communication with the outlet of at least one of main fuel nozzles 307*a*-307*c*. A tip 313 of direct spark ignitor 312 is positioned proximate to an outlet of main fuel nozzle 307*b*.

As shown in FIGS. 6 and 7A, a diffusing element 316 is positioned proximate to the outlets of main fuel nozzles 307*a*-307*c* creates a low pressure recirculation-ignition zone 309 in an airflow path downstream from air circuit 308 immediately as it exits burner system 300 and enters a furnace 301 such that recirculation zone 309 will occur at the ignition location of the direct ignition main gas burner. In system 300, the diffusing element is embodied as a perforated plate 316. Perforated plate 316 creates zone 309 for the mixing of fuel and air that remains stable under varying burner settings and fuel and air flows, thereby reducing $NO_x$ emissions as compared with traditional burner systems. Perforated plate 316 also allows consistent and reliable light-off of main gas nozzle 307*b* using direct ignition under varying conditions. Once main gas nozzle 307*b* is ignited, main gas nozzles 307*a* and 307*c* are ignited by the flame from main gas nozzle 307*b*.

As shown in FIGS. 6 and 7A, a guide slot 331 is included in perforated plate 316 to provide support for direct spark ignitor 312. Similar to system 200, system 300 can include a flame scanner 315, similar to flame scanner 115, with a sight tube 315*a* mounted to the burner front plate 353. Sight tube 315*a* is aimed so that it views adjacent to the fuel nozzles 307*a*-307*d* and can sight the flame. A guide tube 318 is mounted to an upstream wall 355 of burner housing 302 and to a burner front plate 353. Direct spark ignitor 312 is nested within guide tube 318 for support.

With reference now to FIGS. 6-7B, system 300 includes a retraction mechanism 324 operatively connected to an upstream end 322 of direct spark ignitor 312. Direct spark ignitor 312 is retractable relative to fuel burner housing 302 to be extended for light-off and retracted in an upstream direction when not in use. Retraction mechanism 324 includes an actuator 360 to drive a plate 362 mounted to direct spark ignitor 312 in an upstream direction and a limit switch 364 configured to stop actuator 360 when needed. FIG. 7A shows direct spark ignitor 312 in a deployed, un-retracted position. FIG. 7B shows direct spark ignitor 312 in an un-deployed, retracted position, as indicated schematically by the arrow pointing in the upstream direction. This retraction mechanism allows for easier maintainability and longer life of direct spark igniter 312. Access holes 326 similar to access holes 126 are included within upstream wall 355 of burner housing 302 to accommodate the retraction and extension of direct spark igniter 312.

With reference now to FIGS. 6-7B, system 300 includes a nozzle retraction mechanism 330 operatively connected to an upstream end 323 of a main fuel supply 319. Main fuel nozzles 307*a*-307*c*, main fuel supply conduits 304*a*-304*c* and main fuel supply 319 are retractable relative to fuel burner housing 302 to be extended when the main fuel supply 319 is in use and retracted upstream when not in use. FIG. 7A show main fuel nozzles 307*a*-307*c*, main fuel supply conduits 304*a*-304*c*, and main fuel supply 319 in a deployed, un-retracted position. FIG. 7B show main fuel nozzles 307*a*-307*c*, main fuel supply conduits 304*a*-304*c*, and main fuel supply 319 in an un-deployed, retracted position, as indicated schematically by the arrow pointing in the upstream direction. This nozzle retraction mechanism 330 allows for easier maintainability and longer life of the nozzles and conduits. When firing, for example, coal but not gas, the retraction of one or more main fuel nozzles 307*a*-307*c* prevents the gas elements from collecting coal slag and ash that can affect burner performance, and also protects against erosion. The retraction further prevents main fuel nozzles 307*a*-307*c*, e.g. gas elements, from overheating when firing coal in the same burner or when the burner is out of service but other burners are in service. Access holes 326 similar to access holes 126 can also be included within burner housing 302 to accommodate the retraction and extension of main fuel supply 319.

Dual fuel burner systems 100, 200 and 300 with direct ignition have a simplified operation compared to a standard dual fuel burner. Systems 100, 200 and 300 require fewer actions and less pieces of equipment to place the burner into service, allowing for faster and more reliable boiler startups and fuel changes. Moreover, fuel burner systems 100, 200 and 300 achieve lower $NO_x$ emissions as compared to traditional high-capacity ignitors by controlled fuel staging and controlled mixing of fuel and air (via bluff bodies) to be able to achieve low $NO_x$ emissions while still being able to use the main fuel to light a secondary fuel.

In accordance with another aspect, a method 400 of operating a dual fuel burner system, e.g. dual fuel burner systems 100, 200 and/or 300, includes extending a direct spark ignitor, e.g. direct spark ignitor 112, 212, or 312, within a dual fuel burner housing, e.g. dual fuel burner housing 102, 202 or 302, proximate to an outlet of at least one of the main fuel nozzles, e.g. main fuel nozzles 107*a*-107*d*, 207*a*-207*c*, or 307*a*-307*c*, as indicated schematically by box 402. The main fuel nozzle can be an oil, gas or coal fuel nozzle. The method includes supplying and igniting a main fuel flow supplied from main fuel supply conduits, e.g. main fuel supply conduits 104*a*-104*c*, 204*a*-204*c*, or 304*a*-304*c*, exiting from the respective outlets of the main fuel nozzles with the direct spark ignitor to place a fuel burner system, e.g. fuel burner systems 100, 200, or 300, into service, as indicated schematically by box 404. The method includes retracting the direct spark ignitor after initial ignition, as indicated schematically by box 405. Retracting can be performed with a retraction mechanism, e.g. retraction mechanisms 124, 224 or 324.

After initial ignition, if it is desired to burn the main fuel, e.g. the fuel supplied through the main fuel nozzles, the method includes increasing main fuel flow through the main fuel supply conduits to the main fuel nozzles, as shown schematically by box 406. For example, all nozzles can be adjusted from 5% heat input to 100% heat input, or from 10% heat input to 100% heat input. This allows the secondary fuel to be ignited by the main fuel at a heat input of 10%, and also allows the main fuel to provide 100% heat input capability. The main fuel nozzle closest to the ignitor, e.g. main fuel nozzle 107*d*, 207*b*, or 307*b*, is used to light off the additional main fuel nozzles. In the event that is desired to burn a secondary fuel after ignition (e.g. before increasing the main fuel main fuel flow), method 400 includes supplying flow to secondary fuel nozzles, e.g. secondary fuel nozzles 114, 214, 314*a* or 314*b*, as shown schematically by box 408. The flame from the main fuel nozzle is used to light off the secondary fuel nozzles. Once the secondary fuel nozzles are ignited, the method 400 includes stopping fuel flow to the main fuel nozzles, as indicated schematically by box 412. It is contemplated that the method can also include retracting one or more of the main fuel nozzles with a nozzle retraction mechanism, e.g. nozzle retraction mechanisms 130 or 330.

If it is desired to switch to the secondary fuel once the furnace is on and burning the main fuel (e.g. after increasing the main fuel main fuel flow), the method 400 includes reducing the main fuel flow supplied to the main fuel nozzles to about ten percent, as indicated schematically by box 410. Then, the method 400 includes supplying a second fuel flow, e.g. a coal fuel flow, through a secondary fuel supply conduit, e.g. secondary fuel supply conduits 106, 206, 306*a*, or 306*b*, to a secondary fuel nozzle exit proximate the outlets of the main fuel nozzles to ignite the secondary fuel flow, as indicated schematically by box 408. The secondary fuel is ignited by the flame produced via the remaining main fuel nozzle. Once the secondary fuel is ignited, the method 400 includes stopping the main fuel flow through the remaining main fuel nozzle, as indicated schematically by box 412. It is contemplated that the method can also include retracting one or more of the main fuel nozzles with a nozzle retraction mechanism, e.g. nozzle retraction mechanisms 130 or 330, once the secondary fuel is ignited. It is contemplated that in some embodiments, secondary fuel nozzles (shown as coal nozzles) can be considered the main fuel nozzles and vice a versa.

With continued reference to FIG. 9, in the event that it is desired to switch from the secondary fuel to the main fuel once the furnace is on and burning the secondary fuel, the method 400 includes reducing the secondary fuel flow to the secondary fuel nozzles to about ten percent, as indicated schematically by box 414. If the main fuel nozzles are retracted, it is contemplated that the method can also include inserting one or more of the main fuel nozzles with a nozzle retraction mechanism, e.g. nozzle retraction mechanisms 130 or 330. Then, the method 400 includes supplying the main fuel flow supplied from a main fuel supply conduit to the main fuel nozzles, as indicated schematically by box 416. The flame from the secondary fuel nozzles will light off the main fuel flow supplied to the main fuel nozzles. Once the main fuel flow is ignited, the method 400 includes stopping the secondary fuel flow through the secondary fuel nozzles, as indicated schematically by box 418.

The methods and systems of the present disclosure, as described above and shown in the drawings, provide for dual fuel burner systems with superior properties including reduced installation time and ease of use. While the apparatus and methods of the subject invention have been shown and described with reference to preferred embodiments, those skilled in the art will readily appreciate that changes and/or modifications may be made thereto without departing from the spirit and scope of the subject invention.

What is claimed is:

1. A dual fuel burner system comprising:

a fuel burner housing;

a main fuel supply conduit within the fuel burner housing configured and adapted to be in fluid communication with a main fuel supply;

a fuel nozzle proximate to a downstream end of the fuel burner housing in fluid communication with the main fuel supply conduit;

a secondary fuel supply conduit within the fuel burner housing configured and adapted to be in fluid communication with a secondary fuel supply;

an air circuit configured and adapted to be in fluid communication with an outlet of the fuel nozzle and an outlet of the secondary fuel supply conduit; and a direct spark ignitor positioned proximate to the outlet of the fuel nozzle configured and adapted to directly ignite the main fuel supply with a high energy spark, wherein each of the main fuel supply conduit and the secondary fuel supply conduit is configured to be capable of supplying a volume of fuel to provide 100% of the heat input requirement of the dual fuel burner system.

2. The dual fuel burner system as recited in claim 1, wherein the main fuel supply conduit is at least one of a gas fuel supply conduit or an oil fuel supply conduit.

3. The dual fuel burner system as recited in claim 1, further comprising a secondary fuel nozzle proximate to the downstream end of the fuel burner housing in fluid communication with the secondary fuel supply conduit.

4. The dual fuel burner system as recited in claim 3, wherein the secondary fuel supply conduit is a coal fuel supply conduit.

5. The dual fuel burner system as recited in claim 3, wherein the secondary fuel supply conduit is in fluid communication with a secondary fuel supply different from a main fuel supply in fluid communication with the main fuel supply conduit.

6. The dual fuel burner system as recited in claim 1, further comprising a flame scanner proximate to the outlet of the fuel nozzle.

7. The dual fuel burner system as recited in claim 1, wherein the outlet of the fuel nozzle includes a diffusing element to create a low pressure recirculation-ignition zone in an airflow path downstream from the air circuit.

8. The dual fuel burner system as recited in claim 7, wherein the diffusing element includes at least one of a perforated plate, a diverging conical body, and a set of trapezoidal shaped plates.

9. The dual fuel burner system as recited in claim 1, further comprising a guide tube mounted to a downstream end of the fuel nozzle, wherein the direct spark ignitor is nested within the guide tube for support.

10. The dual fuel burner system as recited in claim 9, wherein the main fuel supply conduit includes a series of main fuel supply conduits disposed circumferentially within the burner housing, wherein the guide tube is positioned alongside one of the main fuel supply conduits in the series of main fuel supply conduits.

11. The dual fuel burner system as recited in claim 1, further comprising a retraction mechanism operatively connected to an upstream end of the direct spark ignitor, wherein the direct spark ignitor is retractable relative to the fuel burner housing to be extended for light-off and retracted in an upstream direction when not in use.

12. The dual fuel burner system as recited in claim 1, further comprising a retraction mechanism operatively connected to the fuel nozzle, wherein the fuel nozzle is retractable relative to the fuel burner housing to be retracted in an upstream direction when not in use.

13. The dual fuel burner system as recited in claim 1, wherein a tip of the direct spark ignitor is positioned proximate an outlet of the main fuel nozzle.

14. The dual fuel burner system as recited in claim 13, wherein the main fuel supply conduit includes a series of main fuel supply conduits disposed circumferentially within the burner housing, each main fuel supply conduit of the series of fuel supply conduits including a respective main fuel nozzle, wherein the tip of the direct spark ignitor is positioned closer to the outlet of one of the main fuel nozzles than a remainder of the main fuel nozzles.

15. A method of operating a dual fuel burner system, the method comprising:

extending a direct spark ignitor within a dual fuel burner housing proximate to an outlet of a main fuel nozzle, wherein a secondary fuel nozzle is proximate the main fuel nozzle;

igniting a main fuel flow from a main fuel supply conduit exiting from the outlet of the main fuel nozzle with a high energy spark from the direct spark ignitor to place the dual fuel burner system into service; and retracting the direct spark ignitor;

wherein:

the main fuel supply conduit is configured and adapted to be in fluid communication with a main fuel supply;

the secondary fuel supply conduit is configured and adapted to be in fluid communication with a secondary fuel supply; and each of the main fuel supply conduit and the secondary fuel supply conduit is configured to be capable of supplying a volume of fuel to provide 100% of the heat input requirement of the dual fuel burner system.

16. The method as recited in claim 15, wherein the main fuel nozzle is one of a plurality of main fuel nozzles each having respective outlets, further comprising supplying the main fuel flow through the main fuel supply conduit to the outlets of the main fuel nozzles.

17. The method as recited in claim 15, further comprising increasing the main fuel flow to the main fuel nozzle by a factor of ten.

18. The method as recited in claim 17, further comprising:

reducing the main fuel flow to the main fuel nozzle by ninety percent;

supplying a secondary fuel flow through the secondary fuel supply conduit to an outlet of the secondary fuel nozzle proximate the main fuel nozzle to ignite the secondary fuel flow; and stopping the main fuel flow to the main fuel nozzle.

19. The method as recited in claim 18, wherein the secondary fuel nozzle is one of a plurality of secondary fuel nozzles each having respective outlets, wherein supplying the secondary fuel flow through the secondary fuel supply conduit to the outlet of the secondary fuel nozzle includes supplying the secondary fuel flow through the secondary fuel supply conduit to the outlets of the plurality of secondary fuel nozzles.

20. The method as recited in claim 15, further comprising:

supplying a secondary fuel flow through the secondary fuel supply conduit to an outlet of the secondary fuel nozzle proximate the main fuel nozzle to ignite the secondary fuel flow; and stopping the main fuel flow to the main fuel nozzle.

21. The method as recited in claim 20, wherein the secondary fuel nozzle is one of a plurality of secondary fuel nozzles each having respective outlets, wherein supplying the secondary fuel flow through the secondary fuel supply conduit to the outlet of the secondary fuel nozzle includes supplying the secondary fuel flow through the secondary fuel supply conduit to the outlets of the plurality of secondary fuel nozzles.

22. The method as recited in claim 20, further comprising:

reducing the secondary fuel flow to the secondary fuel nozzle;

supplying the main fuel flow through the main fuel supply conduit to the outlet of the main fuel nozzle proximate the secondary fuel nozzle to ignite the main fuel flow; and stopping the secondary fuel flow to the secondary fuel nozzle.

23. The method as recited in claim 22, wherein the main fuel nozzle is one of a plurality of main fuel nozzles each having respective outlets, wherein supplying the main fuel flow through the main fuel supply conduit to the outlet of the main fuel nozzle includes supplying the main fuel flow through the main fuel supply conduit to the outlets of the plurality of main fuel nozzles.

* * * * *